US006276407B1

(12) United States Patent
Corfitsen

(10) Patent No.: US 6,276,407 B1
(45) Date of Patent: Aug. 21, 2001

(54) DEVICE FOR AUTOMATIC REFUELLING OF VEHICLES

(75) Inventor: Sten Corfitsen, Lidingö (SE)

(73) Assignee: Autofill Patent AB, Lidingo (SE)

( * ) Notice: Subject to any disclaimer, the term of this patent is extended or adjusted under 35 U.S.C. 154(b) by 0 days.

(21) Appl. No.: 09/700,018

(22) PCT Filed: May 5, 1999

(86) PCT No.: PCT/SE99/00754

§ 371 Date: Mar. 2, 2001

§ 102(e) Date: Mar. 2, 2001

(87) PCT Pub. No.: WO99/59912

PCT Pub. Date: Nov. 25, 1999

(30) Foreign Application Priority Data

May 7, 1998 (SE) ..... 9801599

(51) Int. Cl.[7] ..... B65B 1/30; B65B 31/00; B67C 3/02

(52) U.S. Cl. ..... 141/94; 141/98; 141/232; 141/284; 141/387; 141/392

(58) Field of Search ..... 141/94, 98, 114, 141/231, 232, 387, 392, 250, 284

(56) References Cited

U.S. PATENT DOCUMENTS 5,628,351 * 5/1997 Ramsey, Jr. et al. ..... 141/98
5,971,040 * 10/1999 McFarland et al. ..... 141/98

* cited by examiner

*Primary Examiner*—Timothy L. Maust
(74) *Attorney, Agent, or Firm*—Alfred J. Mangels

(57) ABSTRACT

A system for automatically fuelling vehicles, primarily automobiles, that includes a sensor to detect the presence of a person in proximity to the fuelling system. A fuelling robot includes a robot head that can be moved relative to the robot to enable the robot head to be brought by a positioning system from a rest position to a predetermined position in relation to the fuel-tank pipe of the vehicle. The robot head is provided with electrically conductive sheet-metal elements that are connected to an oscillating electric circuit. A sensing circuit senses a change in the frequency of the oscillating circuit that results from a change in the capacitance between the sheet-metal elements, such as when a person is near the fuelling robot. The sensing circuit activates an alarm in response to a predetermined frequency change, to warn a person who is too near the fuelling robot.

8 Claims, 1 Drawing Sheet

Fig. 1
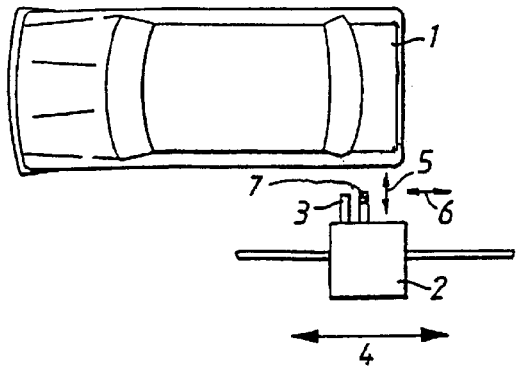
Fig. 2
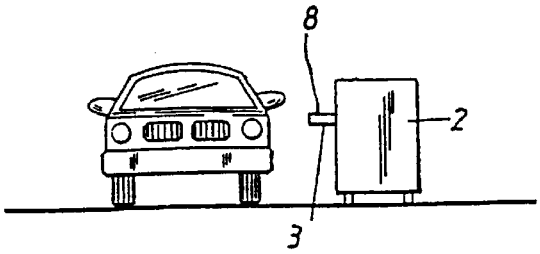
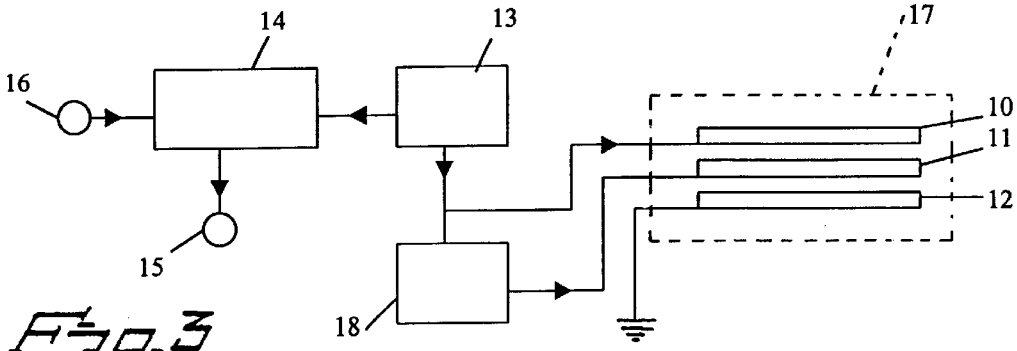
Fig. 3
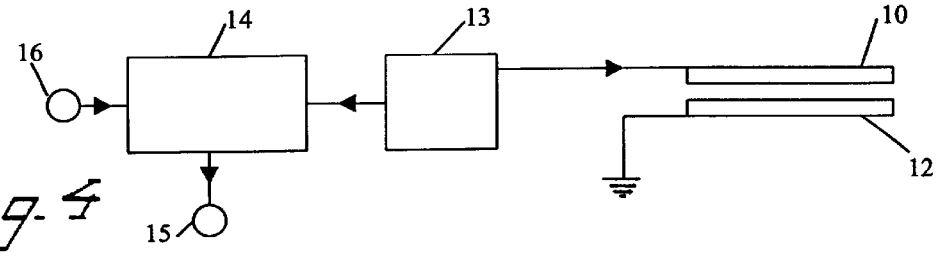
Fig. 4

DEVICE FOR AUTOMATIC REFUELLING OF VEHICLES

BACKGROUND OF THE INVENTION

1. Field of the Invention

The present invention relates to a system pertaining to the automatic fuelling of vehicles, primarily automobiles, where a robot is used to open the fuel-tank flap of the vehicle on the one hand and to fuel the vehicle on the other hand.

2. Description of the Related Art

Swedish Patent Specification No. 8901674-5 describes such an automobile automatic fuelling system.

The system according to this earlier publication comprises a robot which includes a fuelling nozzle or the like, and a detecting and guiding system which functions to move the fuelling nozzle automatically from a rest position to a vehicle fuelling position, subsequent to the vehicle having been placed in a predetermined position relative to the robot. The fuelling nozzle includes a rigid, first tubular element which is moved by the robot towards and against an adapter provided with a hole belonging to the vehicle fuelling position. A flexible second tube is displaceably arranged within the first rigid tube and is moveable from a first end position in which the outer free end of the second tube is placed within the first tube, to a second end position in which the second tube projects out from the first tube. A tube connection is provided between said hole and the vehicle fuelling pipe. The robot is designed to move the free end of the second tube out of the first tube and down into the tube connection or down into the vehicle fuelling pipe, and pump fuel through the second tube down into the fuel tank of the vehicle.

Swedish Patent Specification No. 9202550-1 teaches a method of opening and closing the fuel tank flap of a vehicle.

According to this letter patent specification there is mounted on the vehicle a transponder which coacts with a transceiver unit on the robot head that contains information regarding the pattern of movement that the robot head shall carry out in respect of the vehicle concerned. The transceiver unit also coacts with the transponder to initially position the robot head relative to the vehicle.

One problem with the automatic fuelling of vehicle where the robot moves relative to a vehicle automatically is that people that are in the vicinity of the robot are in danger of being injured if they stand between the vehicle and the robot.

It is thus very desirable to be able to monitor the proximity of the robot with respect to the presence of people in the vicinity.

The present invention fulfils this desire in a very simple and positive manner.

SUMMARY OF THE INVENTION

The present invention thus relates to a system for the automatic fuelling of vehicles, primarily automobiles, which comprises a robot that includes a robot head which can be moved relative to the robot from a rest position to a predetermined position relative to the vehicle fuelling pipe by means of a positioning system. The robot head includes a tube which is adapted to be docked with the upper orifice of the vehicle fuel pipe, whereafter fuel is delivered to the vehicle. The robot head also carries a devices for opening a vehicle fuel tank flap, and is provided with electrically conductive sheet-metal elements on or adjacent the robot head. The sheet-metal elements are connected to an oscillating electric circuit; and a sensing circuit is provided for sensing a change in the frequency of the oscillating circuit as a result of a change in the capacitance between the sheet-metal elements. The sensing arrangement is adapted to activate an alarm when sensing a frequency change.

BRIEF DESCRIPTION OF THE DRAWINGS

The invention will now be described in more detail partly with reference to exemplifying embodiments shown in the accompanying drawings, in which FIG. 1 illustrates schematically and from above a vehicle stationed at a robot of the type in question;

FIG. 2 is a front view of a vehicle stationed adjacent a robot;

FIG. 3 is a block schematic illustrating a first embodiment of a system in accordance with the present invention; and FIG. 4 is a block schematic illustrating a second embodiment of a system in accordance with the present invention.

DESCRIPTION OF THE PREFERRED EMBODIMENTS

FIGS. 1 and 2 are schematic illustrations of a vehicle automatic fuelling station, primarily for fuelling automobiles 1. The station includes a robot 2 that has a robot head 3 which can move relative to the robot and be brought to a predetermined position relative to the fuel tank filling pipe of the vehicle. The robot may be moveable in the direction indicated by the arrow 4. The robot head 3 is moveable in the directions indicated by the arrows 5 and 6 and also in a direction perpendicular to the plane of the paper.

According to second-mentioned Swedish patent, the robot head 3 is positioned relative to the tank filling pipe of the vehicle by means of a positioning system that includes a transceiver unit adjacent the robot head. This transceiver unit may be designed to operate at microwave frequency with a passive transponder placed in a predetermined position on the vehicle in relation to the tank flap or cover. A positioning system is described in Swedish Patent Specification No. 8403564-1. Other positioning systems are described in Swedish Patent Specifications Nos. 9702010-1 and 9702011-9.

The robot head 3 also carries an opening device 7 which functions to open the fuel-tank flap of a vehicle 1 in response to movements of the robot head.

An opening and docking sequence takes place in the following way: The vehicle is placed in a predetermined position in relation to the robot, although reasonable deviations from this predetermined position are allowed. The robot is then positioned relative to the fuel-tank flap. The robot head is then moved in accordance with a movement pattern, so as to open the fuel-tank flap.

The robot head 3 then docks the outer tube with the adapter, whereafter the inner tube is inserted down into the fuel-tank pipe. Fuel is then delivered to the fuel-tank pipe through the inner tube.

When the vehicle has been fuelled, the aforedescribed movements are carried out in the reverse order, wherewith the fuel-tank flap is closed and the robot returns to its original starting position.

The aforedescribed procedures are described in the above-identified patent specifications.

According to the present invention, the robot head 3 is provided with electrically conductive sheet-metal elements 10, 11, 12 (see FIG. 3) which may be mounted on the robot head or adjacent said head. The sheet-metal elements are connected to an electric oscillating circuit 13. Furthermore, there is provided a sensing circuit 14 which is designed to sense a change in the frequency of the oscillating circuit 13 caused by a change in the capacitance between the sheet-metal elements 10–12. The sensing circuit 14 triggers an alarm device 15 in response to a frequency change.

As shown in FIG. 4 the oscillating circuit 13 includes an oscillator which is connected to a sheet-metal sensor element 10. There is also provided a grounded sheet-metal element 12. Capacitance changes between the sheet-metal elements 10 and 12 are sensed in accordance with the invention.

Only two sheet-metal elements are shown in the FIG. 4 embodiment. In a highly preferred embodiment shown in FIG. 3, however, there is provided a further sheet-metal element 11 which lies between the sensing element 10 and the grounded element 12. This further sheet-metal element 11 forms a screen. The screen 11 is supplied with the same signal as the sensing sheet-metal element 10, although via a drive circuit 18 in the form of a voltage follower. This latter embodiment improves sensitivity.

According to one preferred embodiment, the operating frequency of the oscillator in oscillating circuit 13 lies in the range of 50 kHz to 200 kHz, where a higher frequency is used in the embodiment that includes the screen 11.

The sensing circuit 14 is conveniently comprised of a microprocessor, said microprocessor being connected to or including an oscillator 16 that functions as a reference oscillator.

According to one preferred embodiment, the sheet-metal elements 10, 11, 12 are arranged in mutually parallel close relationship to provide a unit in the form of a sandwich element 17 as indicated in broken lines in FIG. 3. The spacing between the sheet-metal elements in a sandwich element may be in the order of some few millimeters. The sandwich element will preferably be built-up with the aid of a typical circuit board, or card, where the sheet-metal elements may consist of copper film on both sides of the circuit board and where said board, or card, carries requisite circuits 13–16 and 18. In the case of the FIG. 3 embodiment, two mutually fastened circuit boards may be included, and the screen 11 may be comprised of a copper layer between said circuit boards, with the sheet-metal elements 10 and 12 lying on the outside of respective boards.

The elements 10–12 may be one or more decimeters times one or some decimeters in area.

As a person approaches the robot head, the capacitance between the earthed sheet-metal element 12 and the other sheet-metal element or elements will change. This will result in a change in the frequency of the oscillator in oscillating circuit 13. In the case of the FIG. 3 embodiment, the frequency will increase whereas in the case of the FIG. 4 embodiment the frequency will decrease. This frequency is fed into the microprocessor of sensing circuit 14 as is also the reference frequency from the oscillator 16. The two frequencies are compared in the microprocessor, which establishes whether or not the frequency from the oscillator 13 has changed relative to the reference frequency. When a predetermined frequency change threshold value is reached, it is considered that a person has entered the sensing area of the system and the microprocessor of sensing circuit 14 will accordingly activate the alarm device 15.

The sensing area ranges from a decimeter to a meter from the sheet-metal elements, depending on the surface area of said elements and their chosen operating frequency.

Accordingly, at least one unit is placed on each side of the robot head in accordance with a preferred embodiment. The robot is constructed so that the robot head will be partially hidden beneath a plastic casing in practice. The units provided are suitably placed on the inside of this plastic casing. Several similar units may also be placed at other positions on the robot, so as to increase the sensing zone.

Naturally, the system may include two or more units of sheet-metal elements 10–12 connected to one and the same oscillator 13 and one and the same microprocessor.

According to a highly preferred embodiment the alarm device will include an emergency stop which stops the robot, when the presence of a person is detected. In this regard, the robot may be constructed to continue its movement when the presence of a person is no longer detected, possibly after having returned to its rest position.

The alarm device 15 may also include several other functions, such as emitting an acoustic signal and/or a light signal.

Although the invention has been described above with reference to a number of embodiments thereof, it will be understood that these embodiments can be modified by the person skilled in this art.

The present invention shall not therefore be considered to be restricted to the aforedescribed embodiments, since variations and modifications can be made within the scope of the following claims.

What is claimed is:

1. A system for automatically fueling vehicles, primarily automobiles, said system comprising: a robot including a robot head that is movable relative to the robot to be brought from a rest position to a predetermined position in relation to a fuel-tank pipe of a vehicle by a positioning system, wherein the robot head includes a tube adapted to be docked with an upper orifice of the fuel-tank pipe for delivering fuel to the vehicle, the robot head including an opening device to open a fuel-tank flap carried by the vehicle; electrically conductive capacitance elements associated with the robot head and connected to an oscillating electric circuit; a sensing circuit operatively coupled with the oscillating circuit to sense a change in frequency of the oscillating circuit occurring as a result of a change in the capacitance between the capacitance elements; and an alarm device coupled with the sensing circuit to provide an alarm in response to a predetermined frequency change.

2. A system according to claim 1, wherein the alarm device includes a robot emergency stop means.

3. A system according to claim 1, wherein the capacitance elements include a grounded sheet-metal element and a sheet-metal sensing element spaced from the grounded sheet-metal element and between which capacitance changes are sensed.

4. A system according to claim 3, including an intermediate sheet-metal element carried between the grounded sheet-metal element and the sheet-metal sensing element to define a screen, and a drive circuit for providing a common signal to the sheet-metal sensing element and to the intermediate sheet-metal element.

5. A system according to claim 3, wherein the sheet-metal elements are disposed in mutually parallel relationship to provide a unit in the form of a sandwich element.

6. A system according to claim 3, wherein at least one unit comprised of said sheet-metal elements is placed on each side of the robot head.

7. A system according to claim 3, wherein the sheet-metal elements have an area of at least about 100 $cm^2$.

8. A system according to claim 1, wherein the operating frequency of the oscillating electric circuit is from about 50 kHz to about 200 kHz.

* * * * *